US005127875A

United States Patent [19]

Fuhrmann et al.

[11] Patent Number: 5,127,875

[45] Date of Patent: Jul. 7, 1992

[54] SUCTION DEVICE FOR THE EXHAUST GASES OF MOTOR VEHICLES

[75] Inventors: Ulrich Fuhrmann, Gross Timmendorf; Michael Spiegel; Torsten Fibelkorn, both of Lübeck, all of Fed. Rep. of Germany

[73] Assignee: NORFI Nordfilter-Anlagenbau GmbH, Ratekau, Fed. Rep. of Germany

[21] Appl. No.: 616,364

[22] Filed: Nov. 21, 1990

[30] Foreign Application Priority Data

Dec. 1, 1989 [DE] Fed. Rep. of Germany ... 8914191[U]

[51] Int. Cl.[5] ..... B08B 15/00

[52] U.S. Cl. ..... 454/64

[58] Field of Search ..... 98/49, 115.4; 104/52; 110/159

[56] References Cited

U.S. PATENT DOCUMENTS

| | | | |
|---|---|---|---|
| 3,602,128 | 8/1971 | Lindkvist | 98/115.4 |
| 4,087,333 | 5/1978 | Naeueutad | 98/115.4 X |
| 4,389,923 | 6/1983 | Ludscheidt | 98/115.4 |
| 4,660,465 | 4/1987 | Jentzsch et al. | 98/115.4 |
| 4,724,751 | 2/1988 | Jentzsch et al. | 98/115.4 |

*Primary Examiner*—Harold Joyce
*Attorney, Agent, or Firm*—Akoo-Toren

[57] ABSTRACT

The suction device for the exhaust gases of motor vehicles moved by a first conveyor (1) onto or over a platform (2), is provided with a suction slotted duct (4) with an elastic, axially-directed lip-type packing (3) located below the platform and through which passes a suction nozzle (22) from suction trolleys (20) moved synchronously with the vehicle. The suction trolley has a suction hood (21) for connecting to the vehicle exhaust. The suction trolley runs on a continuous rail with return section (5), the suction slotted duct being at a higher level. In order to avoid a mechanical coupling of the suction trolley and motor vehicle or exhaust and therefore the corresponding use of manpower, in addition to the first conveyor (1) for the vehicles a second continuous conveyor (9) moved synchronously with the first is provided and has a plurality of drivers (10) for the suction trolleys (20). On each suction trolley is provided a motor-operated, preferably by an electromagnet (29), pawl (30) which forms and interrupts the connection and coupling to a driver (10) of the second conveyor (9). By a correspondingly adapted control with the aid of a parallel, continuous contact rail (8) the pawls (30) are connected to or separated from the drivers, such that the suction trolleys or their hoods (21) are automaticallly connected to the exhaust of the associated vehicle and after passing through a test section are separated therefrom again.

11 Claims, 3 Drawing Sheets

SUCTION DEVICE FOR THE EXHAUST GASES OF MOTOR VEHICLES

BACKGROUND OF THE INVENTION

1. Field of the Invention

The invention relates to a suction device for the exhaust gases of motor vehicles moved by a first conveyor over or on a platform. The device includes a suction slotted duct positioned below the platform and having an elastic, axially directed lip-type packing. Suction nozzles of suction trolleys with suction hoods extend through the lip-type packing. The suction trolleys are moved synchronously with the motor vehicle for connection to the exhaust of the motor vehicle. The device further includes a continuous rail with a return section for the suction trolleys.

2. Description of the Related Art

German patent 35 25 293 discloses a suction device of the aforementioned type, in which the suction trolley is mechanically connected by a coupling to the associated vehicle during suction, i.e. during its movement through the suction slotted duct. This ensures the movement with the first conveyor or with the vehicle. Such a mechanical coupling is labor-costly and can lead to damage to the vehicle.

SUMMARY OF THE INVENTION

The problem of the invention is to provide a suction device of the aforementioned type, where there is no longer any need for a mechanical coupling, i.e. a forced coupling between the motor vehicle and the suction trolley. This problem is solved by providing a second continuous conveyor which is moved synchronously with the first conveyor and which includes a plurality of drivers for the suction trolleys. Each suction trolley has a motor-operated pawl for engaging one of the drivers.

Due to the fact that, according to the invention, a second conveyor is provided for the suction trolley, each suction trolley can be so automatically moved by a suitable control to the exhaust of the particular vehicle, that it reliably fulfills its suction function and no vehicle damage occurs. At the same time the "connection" to and the separation from the exhaust takes place automatically in the vicinity of the suction slotted duct. No intervention on the part of the operator is needed.

Advantageously the device includes a contact rail extending parallel to the continuous rail for the suction trolleys. The contact rail is subdivided into individual, electrically independently engageable and disengageable switching sections and connected via current collectors on each suction trolley to the motor actuating means of the pawl of the suction trolleys. As a result of the individual switching sections of the contact rail or busbar the suction trolleys can be so controlled, i.e. stopped or moved as to form the connection between the suction hood and the corresponding exhaust and after movement over the area of the suction slotted duct to interrupt said connection again which, as stated, has no mechanical coupling. The individual switching sections of the contact rail are supplied by a central control unit with the corresponding switching pulses, i.e. if an electromagnetic ensures the control of the engagement with the drivers, the corresponding section is supplied with power in order to form the connection and is switched in currentless manner in order to separate said connection. Preferably there is a low voltage supply of e.g. 24 V. In order to prevent one suction trolley from striking another, each suction trolley of the suction device is advantageously provided with a photocell for separating the pawl from the driver as the suction trolley approaches a preceding suction trolley in conveying direction.

In accordance with additional features of the invention, a buffer zone for collecting and making ready suction trolley is provided in the return section of the rail. In addition, a lock for moving suction trolleys in and out with respect to a parallel shunting and/or repair rail is provided in the return section of the continuous rail. The buffer zone, which has a starting position at its end in the conveying direction ensures that there are always sufficient suction trolleys. The lock allows a movement in and out for repair or maintenance purposes.

In the sensitive area the switching sections are correspondingly short in order to initiate the necessary control processes. The return section of the continuous rail is advantageously located at a lower level than the suction slotted duct and a rising entry section and a falling exit section are provided between the suction slotted duct and the return section, so that the suction trolleys for connection to the motor vehicle can be moved up to the latter or the exhaust and when suction has taken place ensures the separation again. Advantageously, the buffer zone is located upstream of the entry section in conveying direction and the lock is located between the exit section and the buffer zone.

In order to permit a reliable separation, there is a stopping section upstream of the moving out section, so as to ensure a reliable separation of the exhaust and the suction hood.

For unforeseen faults, it is possible to provide a safety coupling between the suction hood and the suction trolley so as to allow a mechanical separation of these parts.

BRIEF DESCRIPTION OF THE DRAWING

The invention is described in greater detail hereinafter relative to a non-limitative embodiment and the attached drawings, wherein show.

DESCRIPTION OF THE PREFERRED EMBODIMENT

Figure 1:
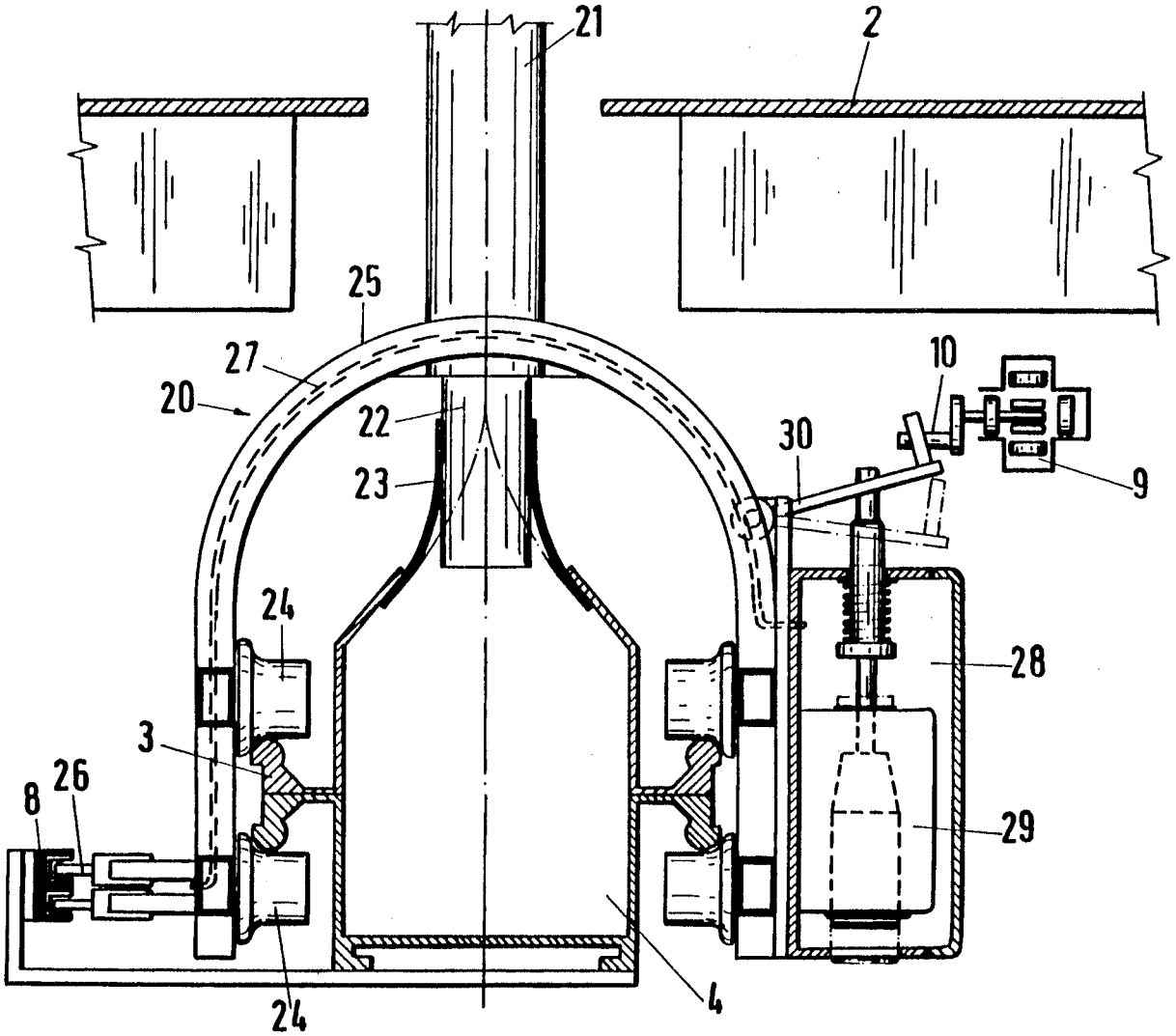
FIG. 1 A cross-section through a suction trolley in the vicinity of the suction slotted duct below a platform.

The suction device shown in the drawings is used for sucking the exhaust gases from motor vehicles, which perform a trail run during the movement through the conveyor 1 over a test section. For this purpose when the suction trolleys are moved over the said test section they must be so "connected" with the vehicle exhaust that reliable suction takes place.

Figure 2:
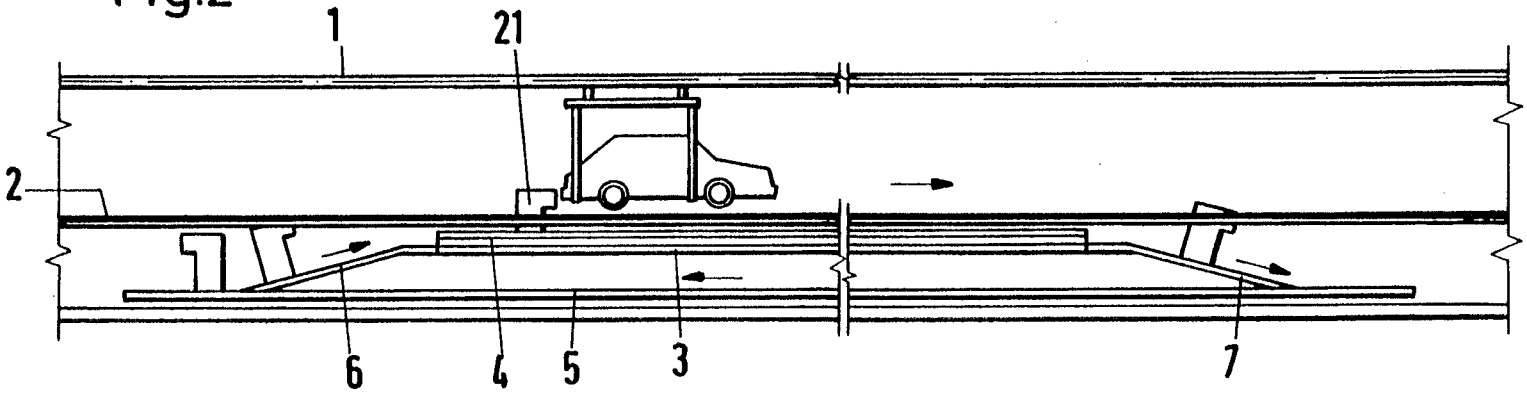
FIG. 2 A diagrammatic side view of a suction device in the vicinity of the suction slotted duct with the motor vehicle indicated.

The motor vehicles, whereof one is diagrammatically indicated in FIG. 2, are moved over a platform 2 by a first conveyor 1, in this case an overhead conveyor. In this area that platform 2 has a slot, below which is positioned a suction slotted duct 4 located between rails 3 which, as shown in FIG. 2, form a continuous, i.e. a closed oval. The return section of the rails 3 is designated 5.

The suction slotted duct 4 with its rials 3 is at a higher level than the return section. Up to said higher level passes an entry section 6 and from it passes downwards on exit section 7.

Figure 3:
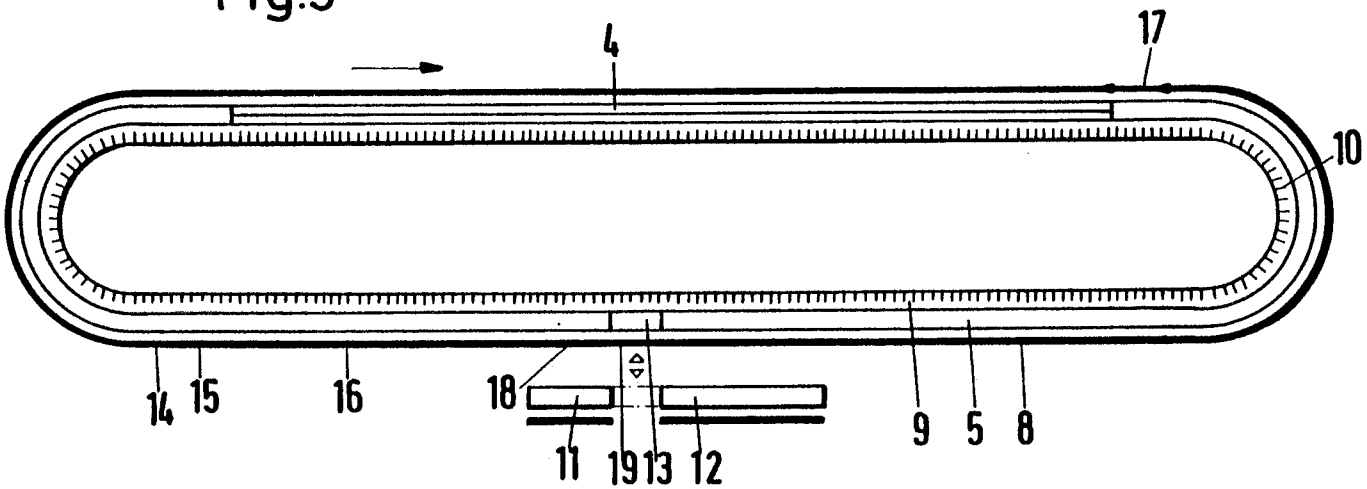
FIG. 3 A plan view of an "oval" of a suction device with the parallel rails and conveyors.

A contact rail or busbar 8 is provided for the suction trolleys 20 parallel to the rail 3 (cf. FIG. 3). This contact rail is on the outside. Within the rail 3 and its return section 5 is provided a second conveyor 9, which is constructed as a chain conveyor (transversely jointed chain). This second conveyor, which is completely independent of the first, is driven synchronously with the latter, so as to synchronize the movements of the suction trolleys with those of the vehicles. Drivers 10 for the individual suction trolleys 20 are provided on the second conveyor 9.

The suction trolleys 20 comprise a frame 25 on which are mounted the runners 24. The latter run on the rails 3, as can in particular be gathered from FIG. 1. Each suction trolley has a suction nozzle 22, which is connected to a suction hood 21 which, through a slot in the platform 2, projects above the latter and onto the plane of the vehicle exhaust. The suction nozzle 22 passes through an elastic lip-type packing 23 of the fixed suction slotted duct 4 and opens the latter and consequently forms the connection with the vacuum within said duct 4. In the test area of the rail 3, the suction slotted duct 4 is located between the latter (FIG. 3) and on a higher level (FIG. 2).

An electromagnet 29 in a casing 28 is located on the frame 25. This electromagnet operates a pawl 30, whose two positions can be gathered from FIG. 1. The electromagnet is connected via electric lines 27 to contacts 26, which engage in the contact rail 8. It can be seen that as a function of whether the electromagnet 29 is supplied with power or not, the pawl 30 assumes a position where engagement takes place with a driver 10, or a position where the connection with the second conveyor 9 is interrupted.

The contact rail is subdivided into individual, electrically separated and independently engageable and disengageable switching sections. Certain of these are shown in FIG. 3 and are designated 14 to 19.

The switching sections 14 to 16 form a buffer zone, where the suction trolleys are made ready prior to coupling in. The final switching section 14 in the conveying direction is the starting section. Here the corresponding suction trolley 20 is started at precisely that time which ensures that on accelerating to the entry section 6 it connects with the associated exhaust.

A special combination and arrangement of sensors and switches permits a vehicle length interrogation and supplies the starting signal for the suction trolley in the starting position. Thus, it is possible for each random vehicle to start a suction trolley at the correct moment.

Figure 4:
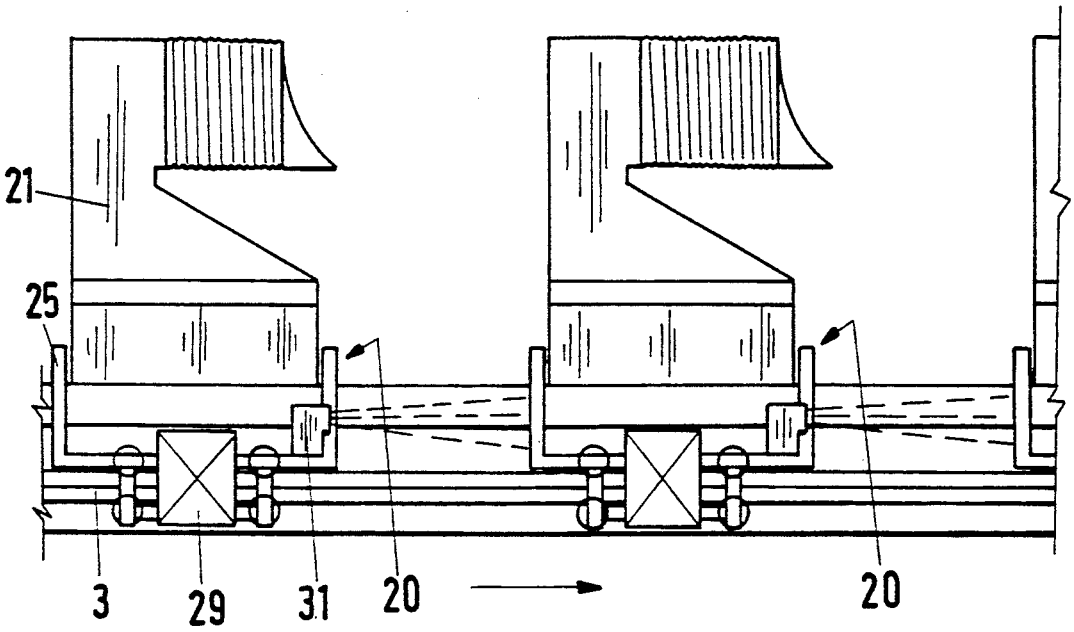
FIG. 4 A suction trolley standing ready in the vicinity of the buffer zone in side view.

As is clear from considering FIG. 4, on each suction trolley 20 is provided a photocell (reflection light sensor) 31 which, on approaching a preceding or stationary suction trolley, ensures that the pawl separates its trolley from the driver and consequently movement is interrupted. This preferably takes place in the buffer zone.

In the conveying direction upstream of the buffer zone is provided a lock 13, which has a section of the rails 3 in the return section 5, which can be laterally moved out, in order to carry out the introduction or removal of suction trolleys on a repair rail 12 or a switching or shunting rail 11. In the vicinity of the lock are provided short switching sections 18, 19 for the contact rail 8, so as to perform the corresponding control pulses. The lock is preferably moved pneumatically. A moving out of suction trolleys takes place e.g. for repair or maintenance purposes.

A special sensor system checks that the top of the suction trolley is correctly seated on the bottom. If there is a reciprocal displacement between the top and bottom, this is detected and the defective suction trolley is automatically moved out.

Shortly prior to the moving out section 7 is provided a stopping section with a corresponding switching section 17 in the contact rail 8, so as to ensure a brief stoppage of the suction trolley and therefore a reliable separation from the exhaust prior to the movement of the lower level in the return section.

In operation a suction trolley is in the starting position in switching section 14. When the motor vehicle has reached the corresponding position on the first conveyor 1, power is supplied to the electromagnet 29 on said suction trolley 20 and the second conveyor moves the trolley synchronously with the vehicle in such a way that after accelerating to the entry section 6 it is connected to the exhaust, i.e. the suction hood 21 is moved over the exhaust. The suction trolleys ready in the buffer zone are correspondingly moved in the conveying direction, so that the next suction trolley is in the starting position.

Separation takes place correspondingly, particularly by a "stop signal" for the switching section 17 of the contact rail 8 and consequently for a brief interruption of the movement of the trolley for separation. After separation the suction trolley is moved back in the direction of the buffer zone on the return section 5. It can optionally be moved out in the lock 13, if this is necessary for repair or maintenance purposes.

In order to obviate unforeseen emergencies, the suction hood is connected by a mechanically separable safety coupling (ball latch) to the associated suction trolley, so that there is a mechanical separation of these parts, e.g. on striking an obstacle.

We claim:

1. In a suction device for exhaust gases of motor vehicles including a first conveyor for moving the motor vehicles over or on a platform, the suction device further including a suction slotted duct located below the platform and having an elastic, axially directed lip-type packing, suction nozzles of suction trolleys extending through the lip-type packing, means for moving the suction trolleys including suction hoods synchronously with the motor vehicle for connection with an exhaust of the motor vehicle, the device further including a continuous rail with a return section for the suction trolleys, the improvement comprising a second continuous conveyor for effecting the movement of the suction trolleys, means for synchronously moving the second continuous conveyor with the first conveyor, the second continuous conveyor comprising a plurality of drivers for the suction trolleys, wherein each suction trolley comprises a motor-operated pawl for engaging one of the drivers.

2. The suction device according to claim 1, wherein the pawl is operated by an electromagnet.

3. The suction device according to claim 1, comprising a contact rail extending parallel to the continuous rail for the suction trolleys, the contact rail being subdivided into individual, electrically independently engageable and disengageable switching sections and being connected via current collectors on each suction trolley to the operating means of the pawl of the suction trolley.

4. The suction device according to claim 1, wherein each suction trolley comprises a photocell for separating the pawl from the driver when the suction trolley approaches a preceding suction trolley in conveying direction.

5. The suction device according to claim 3, wherein the return section of the rail comprises a buffer zone for collecting and readying the suction trolleys.

6. The suction device according to claim 5, wherein the return section of the rail comprises a lock for moving the suction trolleys between the return section and a parallel rail.

7. The suction device according to claim 6, wherein the switching sections of the contact rail are shorter in the vicinity of the buffer zone and the lock than in the remaining areas thereof.

8. The suction device according to claim 6, wherein the return section of the rail is located at a lower level than the suction slotted duct, the device further comprising a rising entry section and a falling exit section between the return section of the rail and the suction slotted duct.

9. The suction device according to claim 8, wherein the buffer zone is located upstream of the entry section in conveying direction and the lock is located between the exit section and the buffer zone.

10. The suction device according to claim 8, comprising a stopping section for separating the suction hood from the exhaust of the motor vehicle, the stopping section being located immediately upstream of the exit section in conveying direction.

11. The suction device according to claim 1, comprising safety coupling means permitting an emergency separation for connection the suction hood to the suction trolley.

* * * * *